US011647573B2

(12) United States Patent
Nie et al.

(10) Patent No.: US 11,647,573 B2
(45) Date of Patent: May 9, 2023

(54) DRIVER CIRCUIT WITH REDUCED CURRENT RIPPLE

(71) Applicant: LEDVANCE GmbH, Garching bei Munchen (DE)

(72) Inventors: Shijun Nie, Garching (DE); Shaoping Chen, Shenzhen Guangdong (CN)

(73) Assignee: LEDVANCE GMBH, Garching bei Munchen (DE)

( * ) Notice: Subject to any disclaimer, the term of this patent is extended or adjusted under 35 U.S.C. 154(b) by 0 days.

(21) Appl. No.: 17/572,847

(22) Filed: Jan. 11, 2022

(65) Prior Publication Data

US 2022/0232681 A1 Jul. 21, 2022

(30) Foreign Application Priority Data

Jan. 15, 2021 (CN) ..... 202110056001.8

(51) Int. Cl.
*H05B 45/345* (2020.01)
*H05B 45/385* (2020.01)

(52) U.S. Cl.
CPC ..... *H05B 45/345* (2020.01); *H05B 45/385* (2020.01)

(58) Field of Classification Search
CPC ..... H05B 45/30; H05B 45/345; H05B 45/385
See application file for complete search history.

(56) References Cited

U.S. PATENT DOCUMENTS 10,727,753 B2 * 7/2020 Portisch ..... H02M 3/33584

* cited by examiner

*Primary Examiner* — Jimmy T Vu
(74) *Attorney, Agent, or Firm* — Hayes Soloway PC

(57) ABSTRACT

A ripple reduction circuit for reducing a current ripple of a driver is provided. The driver circuit comprises an input section with input contacts for connecting the driver circuit to an AC power supply providing an AC input current and a power section for providing an output power, the power section comprising a power transformer and a power switch connected in series with a primary winding of the power transformer. The driver circuit further comprises a ripple reduction circuit with an inductance and a capacitive and two diodes, the ripple reduction circuit being configured such that, in operation, the inductance and the capacitance can be alternately charged and discharged, depending on the switching state of the power switch.

14 Claims, 4 Drawing Sheets

DRIVER CIRCUIT WITH REDUCED CURRENT RIPPLE

CROSS-REFERENCE TO RELATED APPLICATIONS

This patent application claims priority from Chinese Patent Application No. 202110056001.8, filed Jan. 15, 2021, which is hereby incorporated by reference in its entirety.

TECHNICAL FIELD

The technical field of the present application generally relates to electric driver circuits. In particular, the present disclosure relates to driver circuits for driving a DC (direct current) consumer.

BACKGROUND

Driver circuits for providing DC current (e.g., for driving DC power consumers, such as LED light engines) are known. Further, LED driver circuits with power factor correction (PFC) circuits are known as well. The known driver circuits often show a current ripple which may cause undesirable effects like irritating stroboscope effect or unhealthy flickering of light generated by the light engines. In order to reduce the current ripple, the drivers are often equipped with electrolytic capacitors which makes the drivers expensive and bulky.

SUMMARY

The object of the present application is to provide a simple and compact driver circuit with reduced current ripple.

According to a first aspect, a ripple reduction circuit for reducing a current ripple of a driver is provided. The ripple reduction circuit is, in particularly, suitable for drivers with driver circuits comprising an input section for connecting the driver to an AC power supply and a power section for providing an output power. The power section of the driver circuit may, in particular, comprise a power transformer and a power switch connected in series with a primary winding of the power transformer. The ripple reduction circuit comprises an inductance, a capacitance, and two diodes. The ripple reduction circuit is configured such that when implemented in the driver circuit, during the operation of the driver, the inductance and the capacitance can be alternately charged and discharged, depending on the switching state of the power switch. By alternatively charging the inductance and the capacitance, the time dependence of the current flowing through the primary winding of the transformer can be modified such that the ripple of the output current is significantly reduced.

The ripple reduction circuit may comprise a first terminal connectable to a first output terminal of the input section of the driver circuit, a second terminal connectable to a second output terminal of the input section of the driver circuit, a third terminal connectable to a first end of the primary winding of the power transformer, and a fourth terminal connectable to a second end the primary winding of the power transformer. By connecting the ripple reduction circuit between the input section and the power section of the driver, a single power stage with reduced current ripple can be realized.

The ripple reduction circuit may be configured such that the current can flow only in one direction through the inductance. In particular, the ripple reduction circuit may comprise one or more diodes defining the flow direction of the current through the inductance. Thus, the reduction of the driver efficiency by back-flow current can be avoided.

According to a second aspect, a driver circuit with reduced current ripple is provided. The driver circuit comprises an input section with input contacts for connecting the driver circuit to a power supply, in particular, the AC mains, providing an AC (alternative current) input current. The driver circuit further comprises a power section for providing an output power current, in particular, to a DC consumer. The power section comprises a power transformer and a power switch connected in series with a primary winding of the power transformer. The driver circuit further comprises a ripple reduction circuit with an inductance and a capacitance. The ripple reduction circuit is configured such that, in operation, the inductance and the capacitance can be alternately charged and discharged, depending on the switching state of the power switch.

By alternately charging and discharging (i.e., accumulating energy and releasing electrical energy) in the inductive element and the capacitive element of the ripple reduction circuit, the time dependence of the current flowing through the primary winding of the transformer can be modified such that the overall ripple of the output current is significantly reduced. Because of a generally monotonous dependence between the current ripple of LED drivers and the light flickering of the LED light engines driven by the LED drivers, the flickering of the light generated by the LED light engines can be reduced as well. The novel driver circuit concept can, thus, help to fulfill stringent present or future requirements on reduced light flickering for healthy lighting.

The power section of the driver circuit may be configured as a power section of a flyback converter. The flyback topology is relatively simple and robust. Further, the flyback topology also provides a galvanic isolation between the power supply and the consumer, making the driver particularly safe.

The inductance and the capacitance may be electrically connected to the input section and the power section, and the ripple reduction circuit may be configured such that when the power switch is on, the inductance is charged, and when the power switch is off, the capacitance is charged. Thus, irrespective of the position of the power switch, the current flowing from the input section can charge the inductance and the capacitance, respectively.

The input section may comprise a diode bridge rectifier, in particular, a full-wave diode rectifier with four diodes, and an output capacitance. The AC current rectified by the diode bridge can be, thus, smoothened and pre-shaped by the output capacitance of the input section.

The driver circuit may comprise a power switch controller, in particular, configured as an integrated circuit (IC), for controlling the power switch such that the power switch current is synchronized with the AC input current, in particular, the AC cycle of the mains.

By synchronizing the power switch current with the AC input current, the power factor (PF) of the driver circuit can be increased. Thus, a single stage driver circuit with reduced current ripple and a power factor correction (PFC) can be provided. In comparison to multiple power stage drivers or drivers with current removers, the present driver circuit is characterized by both high efficiency and simplicity.

The power switch controller may be configured for adjusting the output current level of the driver circuit by controlling the opening and closing of the power switch. By adjusting the output current of the driver, the luminous flux of the light engine driven by the driver can be adjusted as well. Thus, a dimmable single PFC circuit with reduced current ripple can be realized.

The ripple reduction circuit may comprise a first diode and a second diode. The first diode and the inductive element may be connected in series with the primary winding of the transformer and the power switch. The second diode may be connected in parallel with the first diode and the primary winding of the transformer such that (i) when the power switch is on, the inductance can be charged via the second diode and (ii) when the power switch is off, the inductance can be discharged, and the capacitor can be charged via the first diode. Such a ripple reduction circuit with just four passive components, one inductance, one capacitance, and two diodes can be easily implemented in a single-stage PFC circuit, in particular, in an existing single-stage PFC circuit.

The driver circuit may further comprise an output section with output contacts for connecting the driver circuit to a DC consumer (e.g., an LED light engine). The output section may be connected with a secondary winding of the transformer. Thus, a complete driver, including the input section, the power section, and the output section, based on the driver circuit with the ripple reduction circuit can be provided. Such a driver is simple, compact, and characterized by low ripple current.

The parameters of the ripple reduction circuit, in particular, the values of the inductance and the capacitance, can be selected such that the ripple current does not exceed 15%. By reaching such a low ripple current, stringent requirements on light flickering can be fulfilled by LED drivers without implementing an electrolytic capacitor.

According to another aspect, an LED luminaire is provided. The LED luminaire comprises an LED light engine for generating light and an LED driver for driving the LED light engine, wherein the LED driver comprises a ripple reduction circuit according to the first aspect. Due to the reduced current ripple of the driver circuit, the LED luminaire is characterized by low light flickering and stroboscopic effects.

In some embodiments, the current ripple of the driver is 15% or less, and the SVM (stroboscopic visibility measure) of the LED luminaire is 0.4 or less. Thus, new stringent regulations on light sources, including light flickering, can be fulfilled by the LED luminaire.

BRIEF DESCRIPTION OF THE DRAWINGS

In the following description, details are provided to describe the embodiments of the present specification. It shall be apparent to one skilled in the art, however, that the embodiments may be practiced without such details.

Some parts of the embodiments have similar parts. The similar parts may have same names or similar part numbers. The description of one part applies by reference to another similar part, where appropriate, thereby reducing repetition of text without limiting the disclosure.

DETAILED DESCRIPTION

Figure 1:
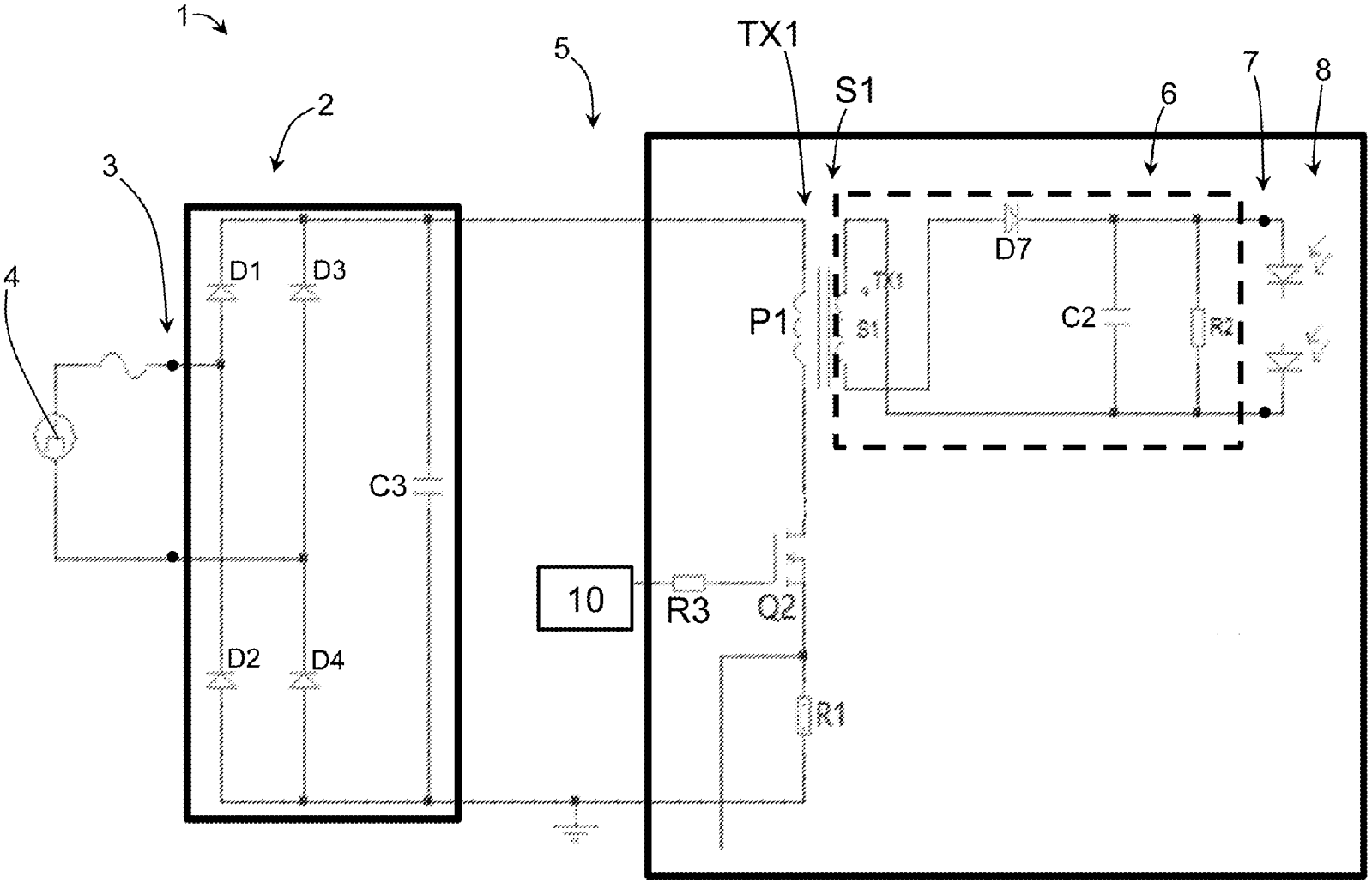
FIG. 1 shows a driver circuit without ripple reduction circuit.

FIG. 1 shows a driver circuit without ripple reduction circuit. The driver circuit 1 comprises an input section 2 with input contacts 3 for connecting the driver circuit 1 to an AC power supply 4 and a power section 5 with a power transformer TX1 and a power switch Q2 which is connected in series with a primary winding P1 of the power transformer TX1. The driver circuit 1 further comprises an output section 6 with output contacts 7 for connecting the output section to a power consumer 8. The output section 6 is electrically connected with a secondary winding S1 of the transformer TX1. The power section 5 shown in FIG. 1 corresponds to the so-called flyback topology. In this example, the driver circuit is an LED driver circuit, wherein the AC power supply 4 is the mains and the DC power consumer 8 is an LED light engine, as shown by corresponding symbols in FIG. 1.

The input section 2 comprises four diodes D1, D2, D3, and D4 configured as a diode bridge rectifier and an output capacitance C3 connected in parallel to the diode bridge.

The driver circuit 1 further comprises a power switch controller 10 electrically connected to a control pin of the power switch Q2 and to the input circuit 2, in particular, to input contacts 3. For the sake of simplicity, the electrical connection of the power switch controller 10 to the input section 2 is not shown in FIG. 1. The power switch controller 10 may be configured such that the opening and closing of the power switch Q2 is synchronized with the AC input current. By synchronizing the power switch Q2 current with the AC input current, the power factor (PF) of the driver circuit 1 can be improved. The power switch controller 10 may be also configured for adjusting the output current level of the driver circuit 1 by controlling the opening and closing time moments of the power switch Q2 within one AC current cycle. By adjusting the output current of the driver, the luminous flux of the light engine driven by the driver can be adjusted or dimmed as well. An LED luminaire with such a driver can, thus, provide a dimmable or no-dimmable light with a low level of flickering and an increased power factor.

Figure 2:
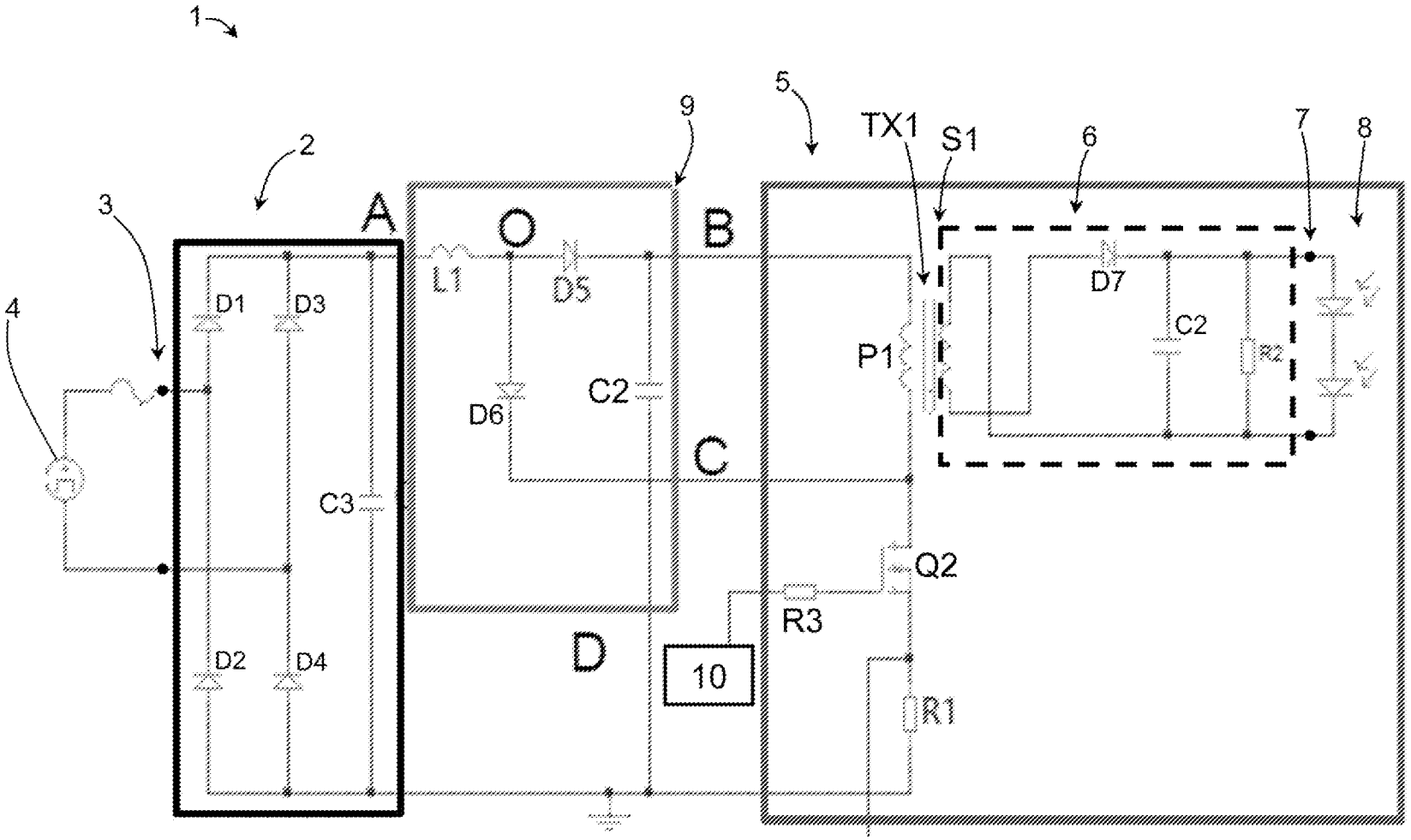
FIG. 2 shows a driver circuit with a ripple reduction circuit according to an embodiment.

FIG. 2 shows a driver circuit with a ripple reduction circuit according to an embodiment. The driver circuit 1 comprises an input section 2 with input contacts 3 for connecting the driver circuit 1 to an AC power supply 4 and a power section 5 with a power transformer TX1 and a power switch Q2 which is connected in series with a primary winding P1 of the power transformer TX1. The driver circuit 1 further comprises an output section 6 with output contacts 7 for connecting the output section to a power consumer 8. The output section 6 is electrically connected with a secondary winding S1 of the transformer TX1. The power section 5 shown in FIG. 1 corresponds to the so-called flyback topology. In this example, the driver circuit is an LED driver circuit, wherein the AC power supply 4 is the mains and the DC power consumer 8 is an LED light engine, as shown by corresponding symbols in FIG. 1.

The input section 2 comprises four diodes D1, D2, D3, and D4 configured as a diode bridge rectifier and an output capacitance C3 connected in parallel to the diode bridge. In contrast to FIG. 1, the driver circuit of FIG. 2 comprises a ripple reduction circuit 9 with an inductance L1 and a capacitance C2. The ripple reduction circuit 9 comprises a first diode D5 and a second diode D6. The first diode D5 and the inductive element L1 are connected in series with the primary winding P1 of the transformer TX1 and the power switch Q2. The second diode D6 is connected in parallel with the first diode D5 and the primary winding P1 of the transformer TX1. The ripple reduction circuit comprises a first terminal A connected to a first output terminal of the input section 2 of the driver circuit 1, a second terminal D connected to a second output terminal of the input section 2 of the driver circuit 1, a third terminal B connected to a first end of the primary winding P1 of the power transformer TX1, and a fourth terminal C connected to the power section between a second end of the primary winding P1 of the power transformer TX1 and the power switch Q2. The anode of the diode D6 is connected at the point O between the anode of the diode D5 and the inductance L1.

In operation, the inductance L1 and the capacitance C2 of the ripple reduction circuit 9 are alternatively charged and discharged, depending on the switching stage of the power switch Q2. In particular, when the power switch Q2 is on (i.e., when the current flows through the power switch Q2), the inductance L1 is charged by the current flowing through the diode D6, meaning that the electrical energy is being accumulated in the inductance L1. When the power switch Q2 is off, on the other hand, the capacitance C2 is charged by the current flowing through the inductance L1 and the diode D5.

By alternatively charging the inductance L1 and the capacitance C2, the time dependence of the current flowing through the primary winding P1 of the transformer TX1 can be modified such that the ripple of the output current is significantly reduced. The effect of the ripple reduction circuit can be also measured by measuring the input voltage of the power section 5, in particular, the reduction of the voltage at the capacitance C2 with the ripple reduction circuit in FIG. 2 as compared with the voltage at the capacitance C3 without the ripple reduction circuit in FIG. 1.

Figure 3:
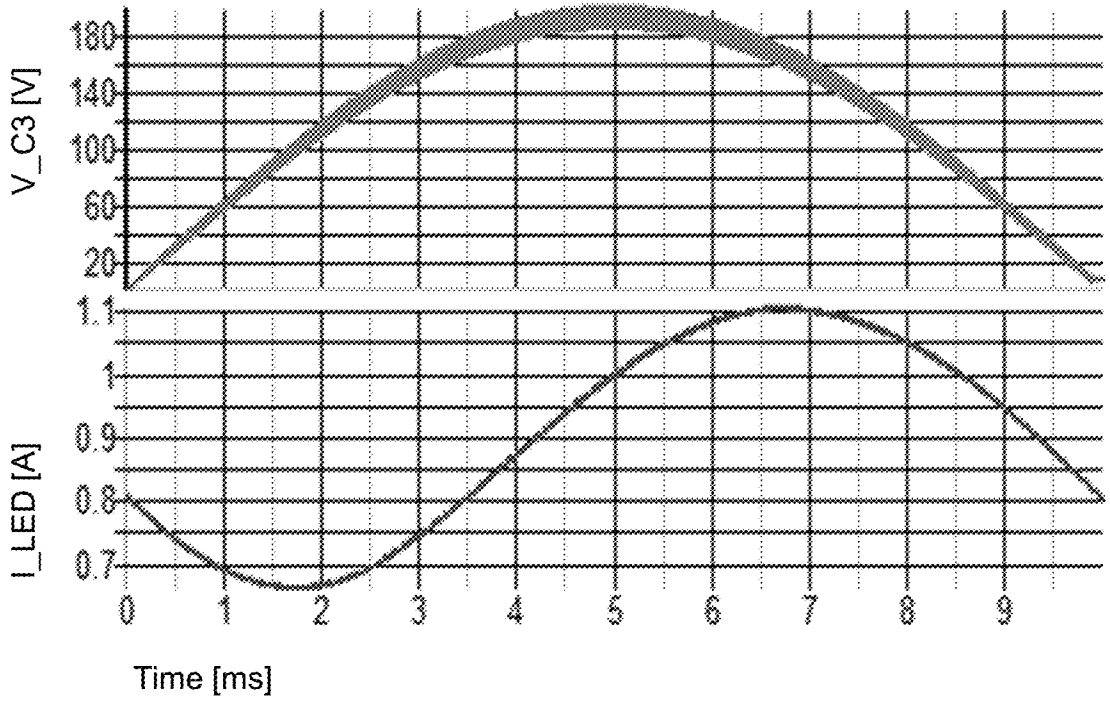
FIG. 3 shows a time dependence of the input voltage of the power section without the ripple reduction circuit and the output current for a driver according to FIG. 1.

FIG. 3 shows a time dependence of the input voltage of the power section 5 without the ripple reduction circuit and the output current for a driver according to FIG. 1. The voltage at the output capacitor C3 of the input voltage of the power section 5 is shown in the upper half of FIG. 3. The lower half of FIG. 3 shows the current I_LED in amperes, flowing through the current consumer 8. The current consumer 8, in the present example, is an LED light engine with an LED chain according to FIG. 1. The peak-peak voltage variation at the capacitor C3 is about 200 V, and the ripple of the output current is about 24.8%.

Figure 4:
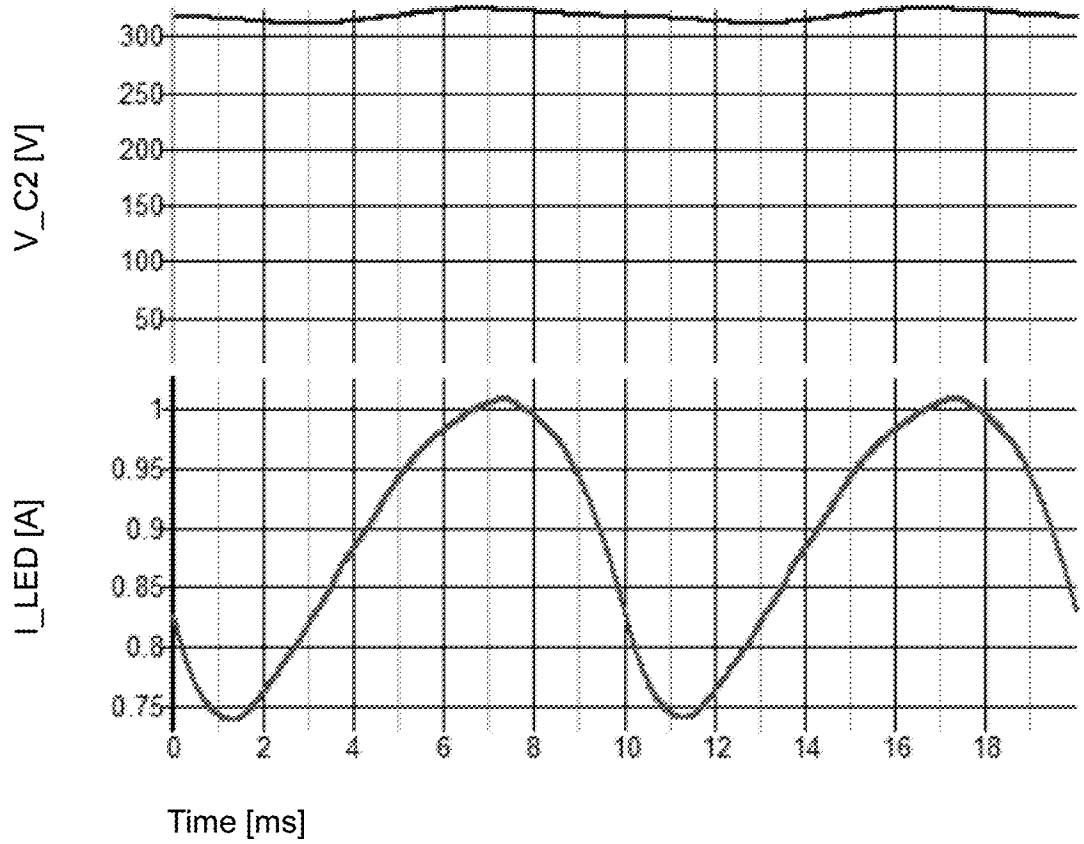
FIG. 4 shows a time dependence of the input voltage of the power section 5 with the ripple reduction circuit voltage and output current for a driver circuit according to FIG. 2.

FIG. 4 shows a time dependence of the input voltage of the power section 5 with the ripple reduction circuit and output current for a driver circuit according to FIG. 2.

The voltage at the capacitor C2 of the input voltage of the power section 5 V_C2 in volts, measured at the capacitance C2 of the ripple reduction circuit 9, is shown in the upper half of FIG. 4. The lower half of FIG. 4 shows the current I_LED in amperes, flowing through the current consumer 8 which is the LED light engine with an LED chain.

The ripple reduction circuit voltage V_C2 measured at the capacitance C2 shows an oscillation with a frequency of 100 Hz, corresponding to the oscillation frequency at the output of the diode bridge rectifier of the input circuit 2. Furthermore, the peak-peak voltage at the capacitor C2 of the input voltage of the power section 5 with the ripple reduction circuit is lower than the peak-peak voltage at the capacitor C3 of the input voltage of the power section 5 without the ripple reduction circuit by about 13.2 V. The reduction of the peak-peak voltage at the capacitance C2 at FIG. 2, as compared with the peak-peak voltage at the capacitance C3 at FIG. 1, results in the reduction of the ripple of the current I_LED flowing through consumer 8 (i.e., the LED chain) by about 15.2%.

The ripple-reducing effect of the ripple reduction circuit 9 can be best seen by comparing the output current of the driver circuit according to FIG. 1, shown in the lower part of FIG. 3, and the output current of the driver circuit according to FIG. 2, shown in the lower part of FIG. 4.

The ripple reduction circuit 9 as described above can be easily implemented in an existing single PFC circuit by adding the few components of the ripple reduction circuit 9, whereby most of the original single PFC circuit components can be maintained.

Thus, just by means of a few additional passive components, a simple and reliable single-stage PFC driver circuit with a power factor of more than 0.9, high efficiency, and small size can be realized. Due to the reduction of the current ripple, the flickering or stroboscope effect of a light source driven by such a driver circuit can be reduced such that stroboscopic visibility measure of 0.4 or lower can be achieved.

Furthermore, the diver circuit described above is simpler and cheaper than a two-stage LED driver, such as a boost-flyback or a flyback-buck driver, and comprises fewer power components. The driver circuit is characterized by high efficiency, especially in contrast to drivers with current removers which are used for reducing the current ripple and which can result in a reduction of efficiency of about 3 to 7%.

The driver circuit described above can be implemented into a dimmable, single-PFC circuit and can keep a low ripple current in the entire dimming range, including dimming levels at which current removers fail or cannot work properly.

Furthermore, the ripple reduction circuit described above can be easily implemented into an existing PFC driver circuit (e.g., controlled by an IC) without affecting the original performance or PFC of the circuit.

While at least one exemplary embodiment has been presented in the foregoing detailed description, it should be appreciated that a vast number of variations exists. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments.

REFERENCE SYMBOLS AND NUMERALS

1 driver circuit
2 input section
3 input contact
4 power supply
5 power section
6 output section
7 output contact
8 DC power consumer
9 ripple reduction circuit
10 power switch controller
C1-C3 capacitance
D1-D7 diodes
I_LED current
L1 inductance
P1 primary winding
R1, R2 resistor
S1 secondary winding
TX1 power transformer
V_C2 voltage
Q2 power switch

What is claimed is:

1. A ripple reduction circuit for reducing a current ripple of a driver with a driver circuit comprising an input section and a power section with a power transformer and a power switch connected in series with a primary winding of the power transformer, the ripple reduction circuit comprising:

an inductance; and a capacitance;

wherein the ripple reduction circuit is configured such that when implemented in the driver circuit, during the operation of the driver, the inductance and the capacitance are alternately charged and discharged, depending on a switching state of the power switch.

2. The ripple reduction circuit according to claim 1, wherein the ripple reduction circuit comprises:

a first terminal connectable to a first output terminal of the input section of the driver circuit;

a second terminal connectable to a second output terminal of the input section of the driver circuit;

a third terminal connectable to a first end of the primary winding of the power transformer; and a fourth terminal connectable to a second end the primary winding of the power transformer.

3. The ripple reduction circuit according to claim 1, wherein the ripple reduction circuit is configured such that current flows only in one direction through the inductance.

4. A driver circuit with reduced current ripple, the driver circuit comprising:

an input section with input contacts for connecting the driver circuit to an AC power supply;

a power section for providing an output power, the power section comprising:

a power transformer; and a power switch connected in series with a primary winding of the power transformer; and a ripple reduction circuit comprising:

an inductance; and a capacitance;

wherein the ripple reduction circuit is configured such that, in operation, the inductance and the capacitance are alternately charged and discharged, depending on a switching state of the power switch.

5. The driver circuit according to claim 4, wherein the power section or the driver circuit is configured as a power section of a flyback converter.

6. The driver circuit according to claim 4, wherein:

the inductance and the capacitance are electrically connected to the input section and the power section; and the ripple reduction circuit is configured such that:

when the power switch is on, the inductance is charged; and when the power switch is off, the capacitance is charged.

7. The driver circuit according to claim 4, wherein the driver circuit comprises a power switch controller for controlling the power switch such that a power switch current is synchronized with an AC input current.

8. The driver according to claim 7, wherein the power switch controller is configured for adjusting an output current level of the driver circuit by controlling opening and closing of the power switch.

9. The driver circuit according to claim 4, wherein the ripple reduction circuit comprises:

a first diode, wherein the first diode and the inductive element are connected in series with the primary winding of the transformer and the power switch; and a second diode, wherein the second diode is connected in parallel with the first diode and the primary winding of the transformer such that:

when the power switch is on, the inductance is charged via the second diode; and when the power switch is off, the inductance is discharged and the capacitance is charged via the first diode.

10. The driver circuit according to claim 4, wherein the driver circuit further comprises an output section with output contacts for connecting the driver circuit to a DC consumer, the output section being connected with a secondary winding of the transformer.

11. The driver circuit according to claim 4, wherein the input section comprises a diode bridge rectifier and an output capacitance.

12. The driver circuit according to claim 11, wherein parameters of the ripple reduction circuit are selected such that a peak-peak voltage at the capacitance of input voltage of the power section with the ripple reduction circuit is less than a peak-peak voltage at the output capacitance of the input voltage of the power section without the ripple reduction circuit.

13. The driver circuit according to claim 4, wherein parameters of the ripple reduction circuit are selected according to a current ripple requirement of about 15% or less.

14. An LED luminaire comprising an LED light engine for generating light and an LED driver for driving the LED light engine, wherein the LED driver comprises the driver circuit according to claim 4.

* * * * *